United States Patent [19]

Winter

[11] 3,949,330

[45] Apr. 6, 1976

[54] COIL AND TRIP MECHANISM

[75] Inventor: John M. Winter, Cedar Rapids, Iowa

[73] Assignee: Square D Company, Park Ridge, Ill.

[22] Filed: Dec. 23, 1974

[21] Appl. No.: 535,903

[52] U.S. Cl. ..... 335/20; 335/265; 335/269

[51] Int. Cl.[2]..... H01H 83/06; H01F 7/08

[58] Field of Search ..... 335/20, 265, 269, 170, 335/174, 119; 317/136

[56] References Cited

UNITED STATES PATENTS 3,559,125 1/1971 Ellis, Jr. ..... 335/20

*Primary Examiner*—Harold Broome

*Attorney, Agent, or Firm*—Harold J. Rathbun; Ernest S. Kettelson

[57] ABSTRACT

A coil and trip mechanism to interrupt an electrical circuit having a dual counter-balanced armature arrangement, one a clapper type armature and the other a plunger type. The clapper armature is mounted for movement between a latched position and a tripped position. The plunger armature is mounted for sliding reciprocal movement in and out of the center of the coil between an extended latched position and a retracted tripped position. The armatures are oppositely spring biased toward each other, the stronger bias being provided by a coil spring urging the plunger armature toward the clapper thus holding it away from the trip coil in the latched position until the trip coil is energized. When the trip coil is energized, its electromagnetic force draws the plunger inwardly compressing the coil spring thus neutralizing its biasing force towards the clapper. The opposite bias urging the clapper toward the trip coil can then become effective and aid the electromagnetic force of the trip coil in moving the clapper from a latched to a tripped position.

12 Claims, 3 Drawing Figures

COIL AND TRIP MECHANISM

BACKGROUND OF THE INVENTION

This invention relates to coil and trip mechanisms for interrupting electrical circuits, and particularly to those for use in assemblies or installations where limitations of space and temperature rise are a factor. Accordingly, the trip coil must be physically small and the temperature rise must be kept low. Such a coil must have a relatively high resistance to lower the heat potential to an acceptable level. However, when the resistance of the coil is increased sufficiently to control temperature rise within acceptable limits, the physically small coil can no longer produce enough electromagnetic force when energized to trip the interrupting mechanism.

Heretofore, coils small enough to meet the space limitation requirements had to have relatively lower resistance in order to generate enough electromagnetic force to trip the interrupting mechanism. If full energizing voltage is applied constantly to such coils, the temperature rise will become great enough to burn out such coils within a relatively short period of time.

It is desirable to use constant rated coils in such limited space applications which do not burn out under conditions whereby energizing voltage is applied constantly to the coil. The present invention accomplishes the desired result by providing a physically small coil plus two oppositely biased armatures with the latched position bias dominant, or sufficiently stronger to bias the armatures away from the coil face and prevent tripping until the coil is energized. One of the armatures is of the clapper type mounted with respect to the coil for movement between a latched position and a tripped position, and having a subordinate bias towards the coil. The other armature is of the plunger type mounted for reciprocal movement inwardly and outwardly of the center of the coil, having a slightly dominant bias outwardly against the clapper armature and away from the coil face. The two armatures are thus counter balanced, with a slightly dominant bias in the direction toward the latched position. When the coil is energized, its electromagnetic force attracting the dual armatures toward the tripped position is aided by the subordinate mechanical bias towards such position. The counterbalanced dual armature arrangement of this invention makes it possible to use a coil which is small in size and yet which is constant duty rated, that is one which has high enough resistance to keep temperature rise low enough under continuous energizing voltage conditions to avoid burning out.

SUMMARY OF THE INVENTION

It is an object of this invention to provide a trip coil and tripping mechanism to interrupt an electrical circuit, including a coil having a physical size small relative to resistance such that it is continously rated but with energy insufficient by itself to trip, and auxiliary energy supply means to aid said coil in tripping the circuit interrupting mechanism.

It is an object of this invention to provide an underpowered trip coil having low temperature rise characteristics for use in combination with dual oppositely biased armatures, said bias being balanced toward a latched position when said coil is de-energized, said bias being adjusted to supply auxiliary energy toward a tripped position when said under-powered coil is energized.

It is an object of this invention to provide a physically small coil for use in a limited space installation, and armature means having a secondary energy source to supply auxiliary power for tripping when said coil is energized.

DESCRIPTION OF PREFERRED EMBODIMENT

Figure 1:
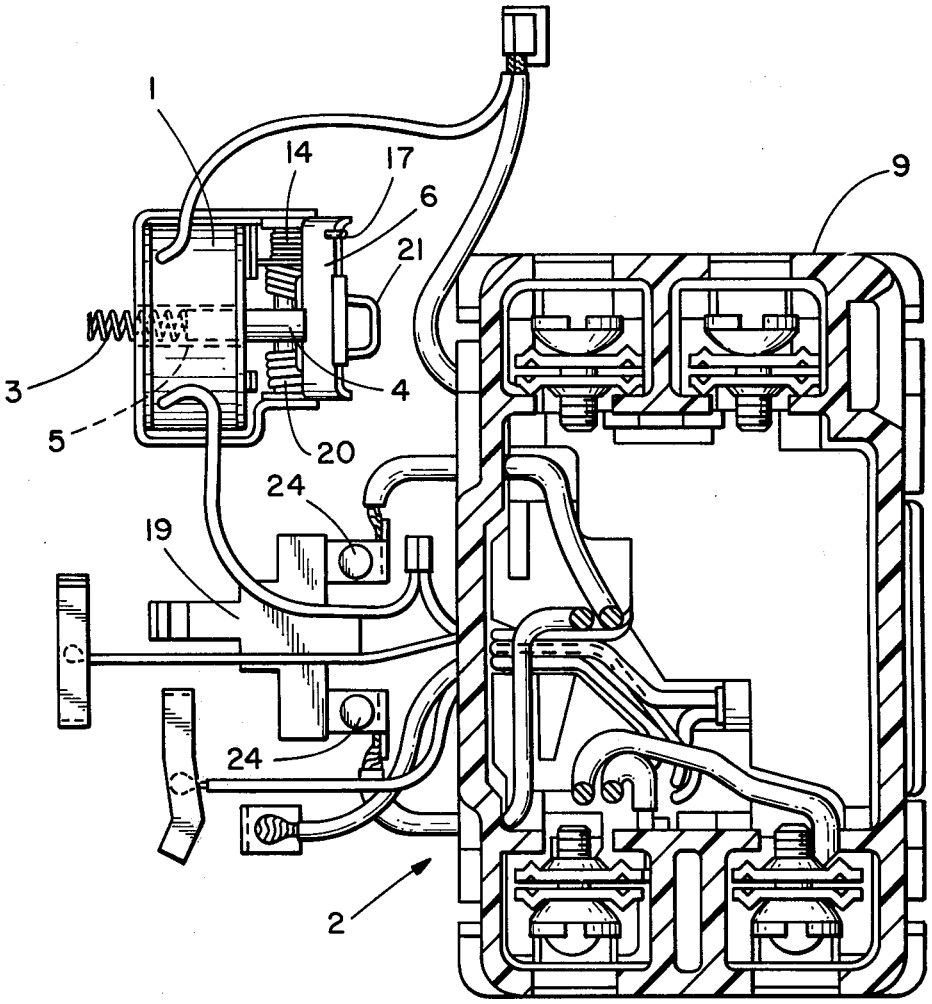
FIG. 1 is a bottom plan view partly in section and partly disassembled of a receptacle having a ground fault protective device incorporated therein which includes a coil and trip mechanism in accordance with this invention.
Figure 2:
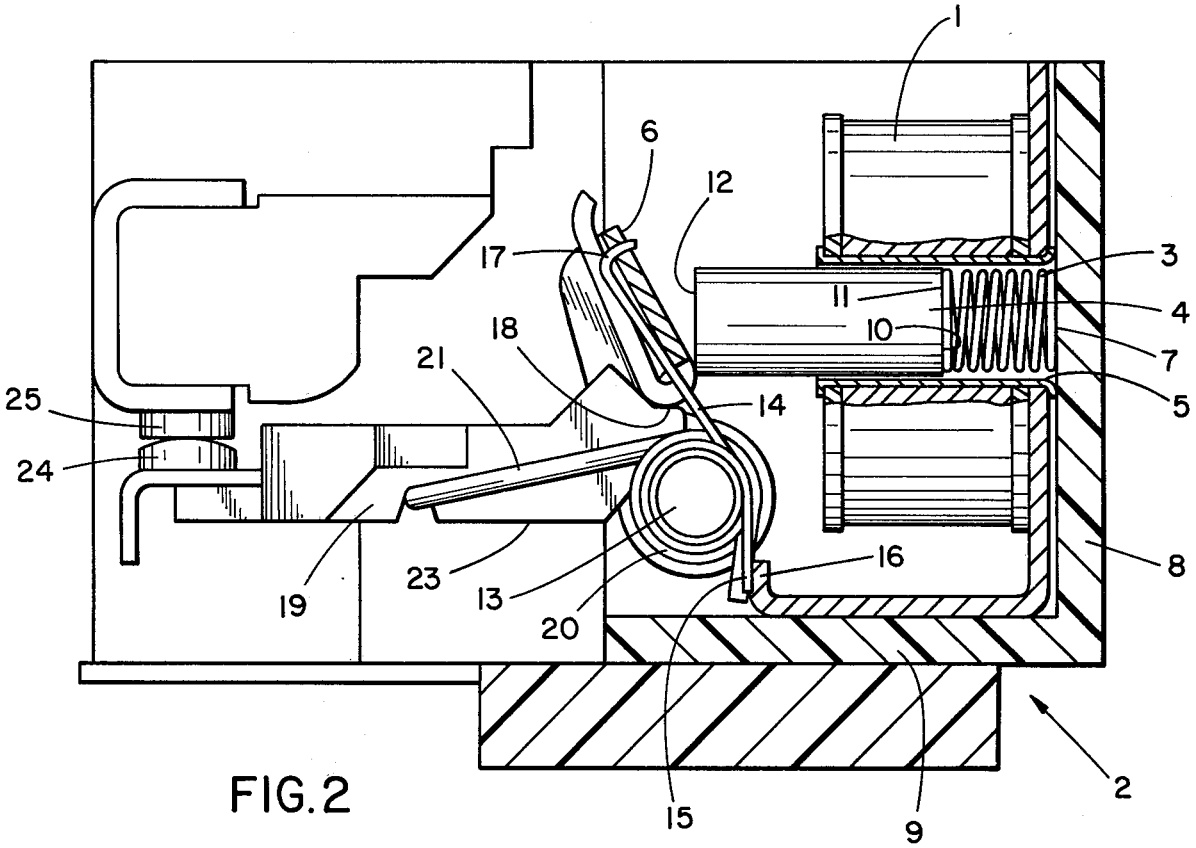
FIG. 2 is a side elevation view of the coil and trip mechanism with the coil being partly sectioned, and the mechanism in latched position.
Figure 3:
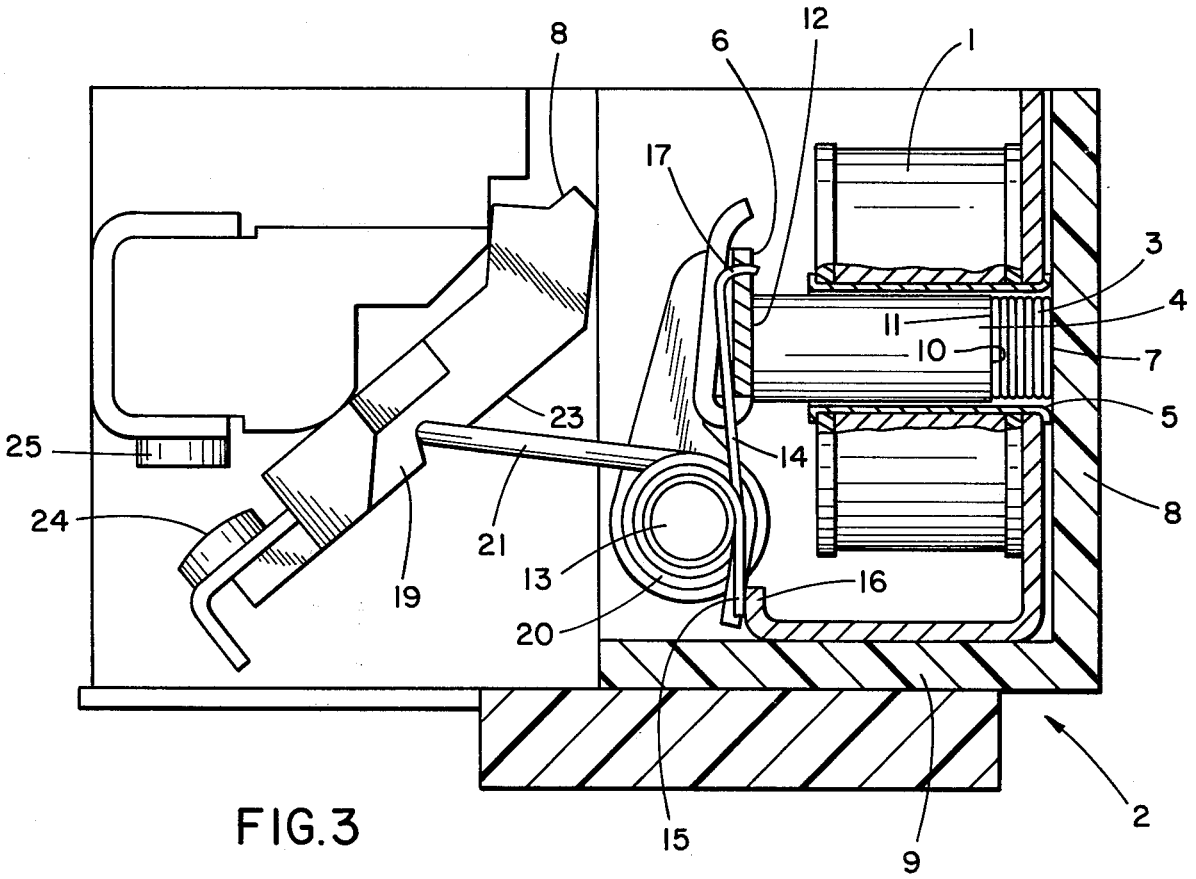
FIG. 3 is a side elevation view of the coil and trip mechanism with the coil partly sectioned, and the mechanism in tripped position.

A trip coil 1 is provided for mounting in an electrical circuit interrupting device 2 having limited space, such as an outlet receptacle having ground fault interrupting means incorporated therein.

Trip coil 1 is small in size and unable to develop sufficient attracting force alone to trip the interrupting mechanism of the device in which it is used. Auxiliary energy means is provided as explained in the following description.

Coil spring 3 and plunger type armature 4, consisting of ferrous rod, are mounted in the cylindrical bore 5 of trip coil 1 for axial movement of the plunger 4 between an extended latching position toward a clapper type armature 6 and a retracted tripped position away from clapper armature 6. Coil spring 3 is positioned within cylindrical bore 5 with one end 7 thereof abutting the bearing wall 8 of outlet receptacle 9. The opposite end 10 of coil spring 3 bears against the inward end 11 of plunger type armature 4. The outward end 12 of plunger type armature 4 is positioned to face clapper type armature 6.

Clapper type armature 6 is mounted for about pivot post 13 for movement between an unlatched position attracted toward trip coil 1 and a latched position biased away from trip coil 1 by plunger type armature 4 bearing thereagainst under the bias of coil spring 3. An auxiliary spring 14 is mounted on pivot post 13, an anchored end 15 thereof bearing against ledge 16 of the coil frame. The opposite movable end 17 of auxiliary spring 14 is secured to clapper type armature 6 to bias it in a direction toward plunger type armature 4.

Thus both armatures 4 and 6 are oppositely biased toward each other. The relative biasing strength of coil spring 3 and auxiliary spring 14 is selected to make coil spring 3 dominant and auxiliary spring 14 subordinate. Coil spring 3 has sufficiently greater biasing strength than auxiliary spring 14 to hold armature 6 in latched position away from trip coil 1 until it is energized. When trip coil 1 is energized, its electromagnetic force draws plunger type armature 4 inward towards a retracted position. The coil spring 3 is thus compressed and its bias towards clapper armature 6 is neutralized.

Energization of trip coil 1 also results in electromagnetic attraction of clapper type armature 6 in the direction towards trip coil 1. Such magnetic attraction is insufficient in itself to pull armature 6 out of latched position bearing against the latching ledge 18 of movable contact carrier 19. However, since the bias of coil spring 3 has now been neutralized, the oppositely biased auxiliary spring 14 becomes dominant. This spring functions as an auxiliary stored energy power supply which is released when the trip coil is energized neutralizing the previously dominant bias of coil spring 3. The bias of auxiliary spring 14 against clapper armature 6 in the direction toward trip coil 1, plus the electromagnetic attraction of the energized trip coil on armature 6, are in combination sufficient to draw armature 6 out of its latched position thereby causing contact carrier 19 to trip.

Contact carrier 19 trips and opens the contacts under the bias of main spring 20 mounted on pivot post 13, with its movable cradle portion 21 seated in groove 22 across the under side 23 of contact carrier 19. The carrier 19 rocks on the cross arm of cradle 21 of main spring 20 to trip. When clapper type armature 6 is moved away from bearing engagement against latching ledge 18 of contact carrier 19, the bias of cradle 21 of main spring 20 against the under side of contact carrier 19 forces the carrier to trip thus separating movable contact 24 from stationary contact 25 to interrupt a circuit through the contacts.

The coil 1 is continously rated, in the sense that a fully energizing voltage may be applied to the coil constantly without causing a temperature rise of sufficient magnitude to burn out the coil. Temperature rise is limited by increasing the resistance of the coil. This decreases the magnetic attraction force of the coil which in view of the small size of the coil makes the supplemental stored energy supply necessary which is provided by counter-balanced armatures 4 and 6. A coil for use in this invention is accordingly one of small physical size relative to its electrical resistance such that it has a continuous full voltage rating and insufficient magnetic energy alone to move the armature from a latched to a tripped position. Full line voltage may therefore be applied continuously to the coil 1 without damage.

As used in the ground fault interrupting mechanism of receptacle 9 by way of example, the auxiliary spring 14 is biased toward trip coil 1 with approximately 1.0 to 1.5 ounces of force. The coil spring 3 is biased oppositely against the end 11 of the plunger type armature 4 and towards the latching position with between 2.0 and 2.5 ounces of force. A net force of 1.0 to 1.5 ounces of return force is the resultant pushing armature 6 toward the latched position. In this embodiment, such net force of 1.0 to 1.5 ounces is required to move armature 6 from the tripped position to the latched position.

When contact carrier 19 is forced downward or in the direction to reset, clapper armature 6 catches on latching edge 18 of the carrier under the urging of the 1.0 to 1.5 ounces of force provided in the direction of latching. When trip coil 1 is energized, electromagnetic force on plunger armature 4 draws it inwardly against the bias of coil spring 3 to a retracted position. The 2.0 to 2.5 ounces of force of coil spring 3 biased towards the latching position is therefore neutralized by energization of the coil 1. The clapper type armature 6 is now biased only by auxiliary spring 14 and its full 1.0 to 1.5 ounce of force is applied to urge the armature 6 in the direction towards the tripped position. Such auxiliary force combined with the electromagnetic force of the coil is sufficient to trip the mechanism even though the electromagnetic force of the coil is insufficient in itself to trip.

I claim:

1. A coil and trip mechanism to interrupt an electrical circuit, including a coil, armature means comprising dual armatures both electromagnetically and operatively associated with said coil for movement between a latched position and a tripped position, and auxiliary stored energy means operable on energization of said coil to supplementally urge said armature means in the same direction of movement as does the electromagnetic force of said coil when energized, said stored energy means including first and second biasing means each of which is associated with a respective one of said dual armatures and oppositely biased toward each other, one of said biasing means being dominant and biasing said oppositely biased dual armatures when said coil is de-energized in the same direction opposite to said direction of movement when said coil is energized.

2. A coil and trip mechanism as set forth in claim 1 wherein said same direction of movement is toward a tripped position and said opposite direction of movement is toward a latched position.

3. A coil and trip mechanism as set forth in claim 1, wherein said coil is of small physical size relative to its electrical resistance such as to withstand continuous full voltage of the circuit without damage while providing insufficient magnetic force alone to move said armature means from a latched to a tripped position.

4. A coil and trip mechanism as set forth in claim 1 wherein said armature means includes a plunger type armature slidingly mounted centrally of said coil for reciprocal movement axially thereof between a retracted and extended position, a clapper type armature pivotally mounted for rotational movement toward said plunger type armature and away therefrom, said stored energy means including first biasing means to bias said plunger type armature toward said clapper type armature, and second biasing means to bias said clapper type armature toward said plunger type armature.

5. A coil and trip mechanism as set forth in claim 4 wherein the biasing force of said first biasing means is greater than the biasing force of said second biasing means.

6. A coil and trip mechanism as set forth in claim 5, wherein the biasing force of said first biasing means is preselected to be of such magnitude that it will be overcome by the electromagnetic force of said coil when energized acting on said plunger type armature to move it towards a retracted position against the force of said first biasing means, the biasing force of said first biasing means being thereby neutralized.

7. A coil and trip mechanism as set forth in claim 6, wherein the biasing force of said second biasing means is preselected to be of such magnitude that it together with the electromagnetic force of said coil when energized acting to attract said clapper type armature is sufficient to move said clapper type armature from a latched position to a tripped position.

8. A coil and trip mechanism as set forth in claim 5, wherein the biasing force of said first biasing means is any magnitude between 2.0 and 2.5 ounces and said biasing force of said second biasing means is any magnitude between 1.0 and 1.5 ounces.

9. A coil and trip mechanism as set forth in claim 4, wherein said first biasing means includes a coil spring mounted rearwardly of the end of said plunger type armature facing said clapper type plunger to bias said plunger type armature toward said clapper type armature said second biasing means includes a tensioned spring mounted between anchor means and said clapper type armature to bias it toward said plunger type armature

10. A coil and trip mechanism as set forth in claim 1 including an outlet receptacle ground fault interrupting means mounted within said receptacle said coil and trip mechanism being operatively associated with said ground fault interrupting means and also mounted within said receptacle, and wherein said coil so mounted within said receptacle is constant rated to withstand full voltage of said circuit applied continuously without damage to said coil.

11. A coil and trip mechanism as set forth in claim 8 wherein the electromagnetic force of said coil when energized is directed oppositely of the biasing force of said first biasing means.

12. A coil and trip mechanism as set forth in claim 11, wherein said electromagnetic force is of a magnitude greater than 2.5 ounces.

* * * * *